United States Patent [19]

Shaw

[11] 3,991,543

[45] Nov. 16, 1976

[54] SEALING UNIT FOR AUTOCLAVE STERILIZATION OF FLEXIBLE PACKAGES

[75] Inventor: Fred B. Shaw, Hinsdale, Ill.

[73] Assignee: Continental Can Company, Inc., New York, N.Y.

[22] Filed: Apr. 21, 1975

[21] Appl. No.: 569,938

[52] U.S. Cl. ..... 53/373; 53/86; 53/112 B

[51] Int. Cl.[2] ..... B65B 51/14; B65B 55/02

[58] Field of Search ..... 53/371, 373, 86, 112 B

[56] References Cited

UNITED STATES PATENTS

| | | | |
|---|---|---|---|
| 2,292,295 | 8/1942 | Royal | 53/112 B X |
| 2,751,965 | 6/1956 | Miller | 53/373 X |
| 3,650,088 | 3/1972 | Wilson | 53/373 X |

*Primary Examiner*—Travis S. McGehee

*Attorney, Agent, or Firm*—Diller, Brown, Ramik & Wight

[57] ABSTRACT

The present invention is directed to a sealing unit for an autoclave for sterilizing contents packaged in pouches and sealing the latter, the sealing unit including a plurality of relatively movable pressure bars which are moved through the lost linkage connection such that open mouthed pouches which are held between opposing pairs of jaws by pairs of clips are first subjected to a sterilization media and thereafter are heat sealed closed.

12 Claims, 9 Drawing Figures

FIG.4
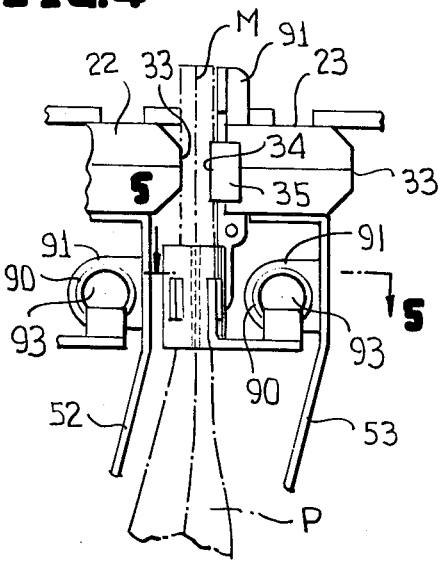
FIG.6
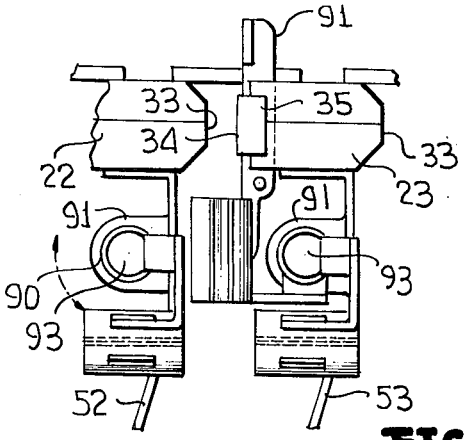
FIG.8
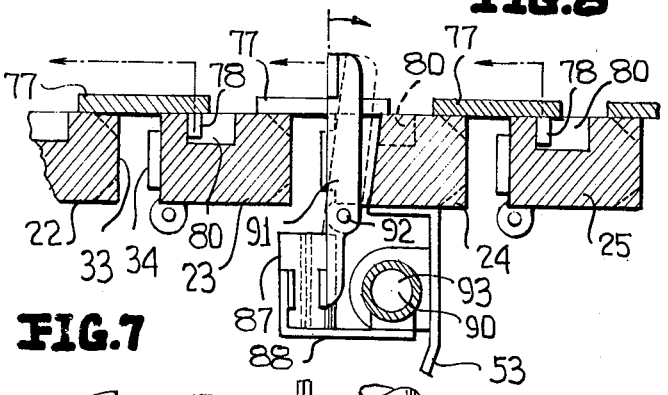
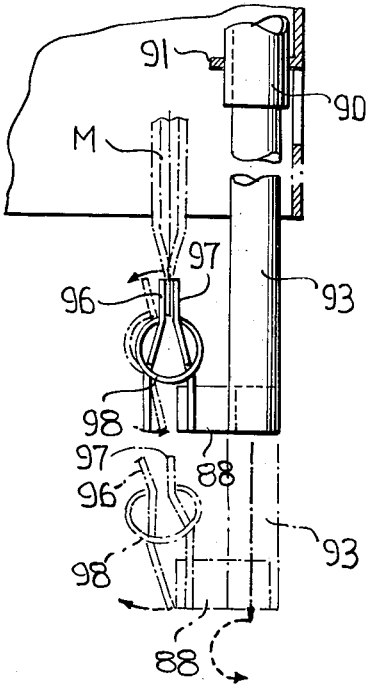
FIG.7
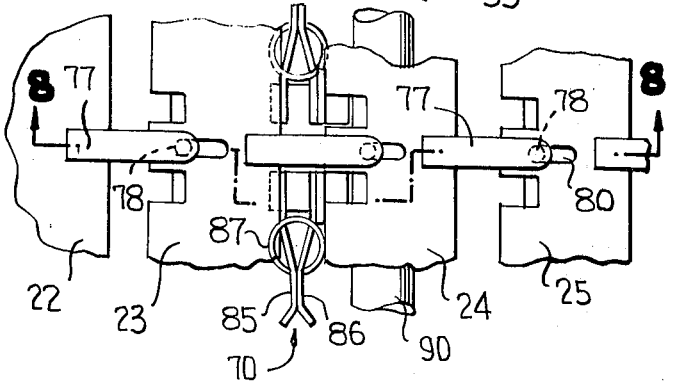
FIG.5
FIG.9
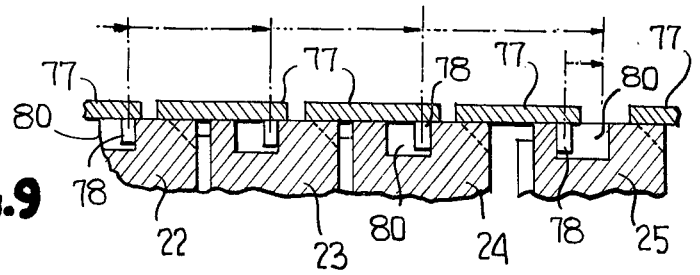

SEALING UNIT FOR AUTOCLAVE STERILIZATION OF FLEXIBLE PACKAGES

The present invention is directed to a novel method of and apparatus for sterilizing the contents of pouches and sealing the pouches closed while in an autoclave and, from an apparatus standpoint, the novelty of the invention resides in a sealing unit which includes means for applying closing pressure to the open mouth of each container, the pressure applying means being a plurality of cooperative pairs of opposing pressure bars, means mounting the pressure bars for relative movement between first relatively opened and second relatively closed positions, and means for relatively moving the pressure bars between the latter-mentioned first and second positions whereby after the contents of pouches have been sterilized the closure of the sealing bars effects the closing of the pouch mouths.

Still another object of this invention is to provide a novel sealing unit of the type heretofore defined wherein the pouches are supported in an adjustable fashion to accommodate both for pouch length and lateral dimensions.

A further object of this invention is to provide a novel sealing unit of the type heretofore described wherein the pouches are individually supported by pairs of clips which can be both pivoted relatively to each other and slid toward and away from each other to both facilitate the loading of pouches into the sealing unit and accommodate for differences in the lateral dimensions thereof.

In accordance with the broadest novel method of this invention open mouthed pouches are first gripped at opposite lateral edges thereof adjacent their mouths, the pouches thus gripped are housed in a chamber with the open mouths uppermost, a heated sterilizing medium is introduced into the chamber whereby the contents are rendered sterile through the ingress of the sterilizing medium into each pouch through the open mouth thereof, and while housed in the chamber the pouch mouths are closed under pressure which thereafter precludes contamination to the contents when the pouches are removed from the sterilization chamber.

With the above and other objects in view that will hereinafter appear, the nature of the invention will be more clearly understood by reference to the following detailed description, the appended claimed subject matter, and the several views illustrated in the accompanying drawings.

IN THE DRAWINGS

FIG. 4 is an enlarged fragmentary side elevational view taken generally line 4—4 of FIG. 3, and more clearly illustrates the manner in which a pouch is clamped between opposing pressure bars.

FIG. 5 is a fragmentary sectional view taken generally along 5—5 of FIG.4, and illustrates the mounting of one of each pair of pouch clips for moving the same relative to each other to accommodate differences in lateral pouch dimensions, as well a pivoting an outermost clip of each pair to an out of the way position for loading purposes.

FIG. 6 is a fragmentary end elevational view similar to FIG. 4, but illustrates two outermost clips pivoted to an out of the way position for loading purposes.

FIG. 7 is a fragmentary top plan view of an enlarged central portion of FIG. 3, and illustrates the manner in which the pressure bars are joined to each other by a lost motion connection.

FIG. 8 is a cross-sectional view taken generally along line 8—8 of FIG. 7, and more clearly illustrates details of the lost motion connection between adjacent pressure bars and a pivoted finger for opening innermost ones of the pouch gripping clips.

FIG. 9 is a fragmentary sectional view similar to FIG. 8, and illustrates several of the pressure bars in the closed position thereof to grip therebetween mouths of pouches.

Figure 1:
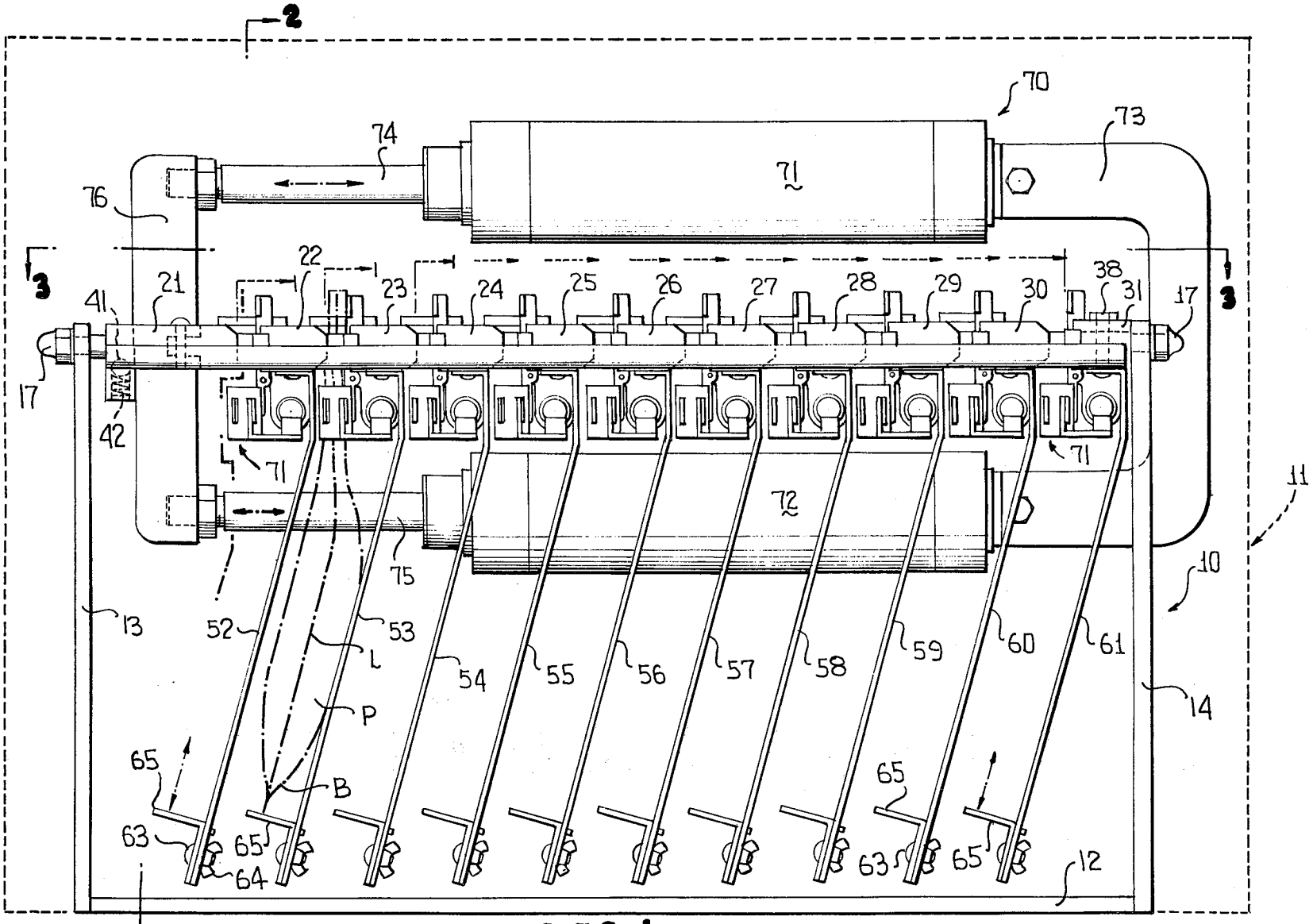
FIG. 1 is a side elevational view of a novel sealing unit constructed in accordance with this invention, and illustrates the manner in which one of a plurality of pouches illustrated in phantom outline is supported within an autoclave during a sterilizing operation.
Figure 2:
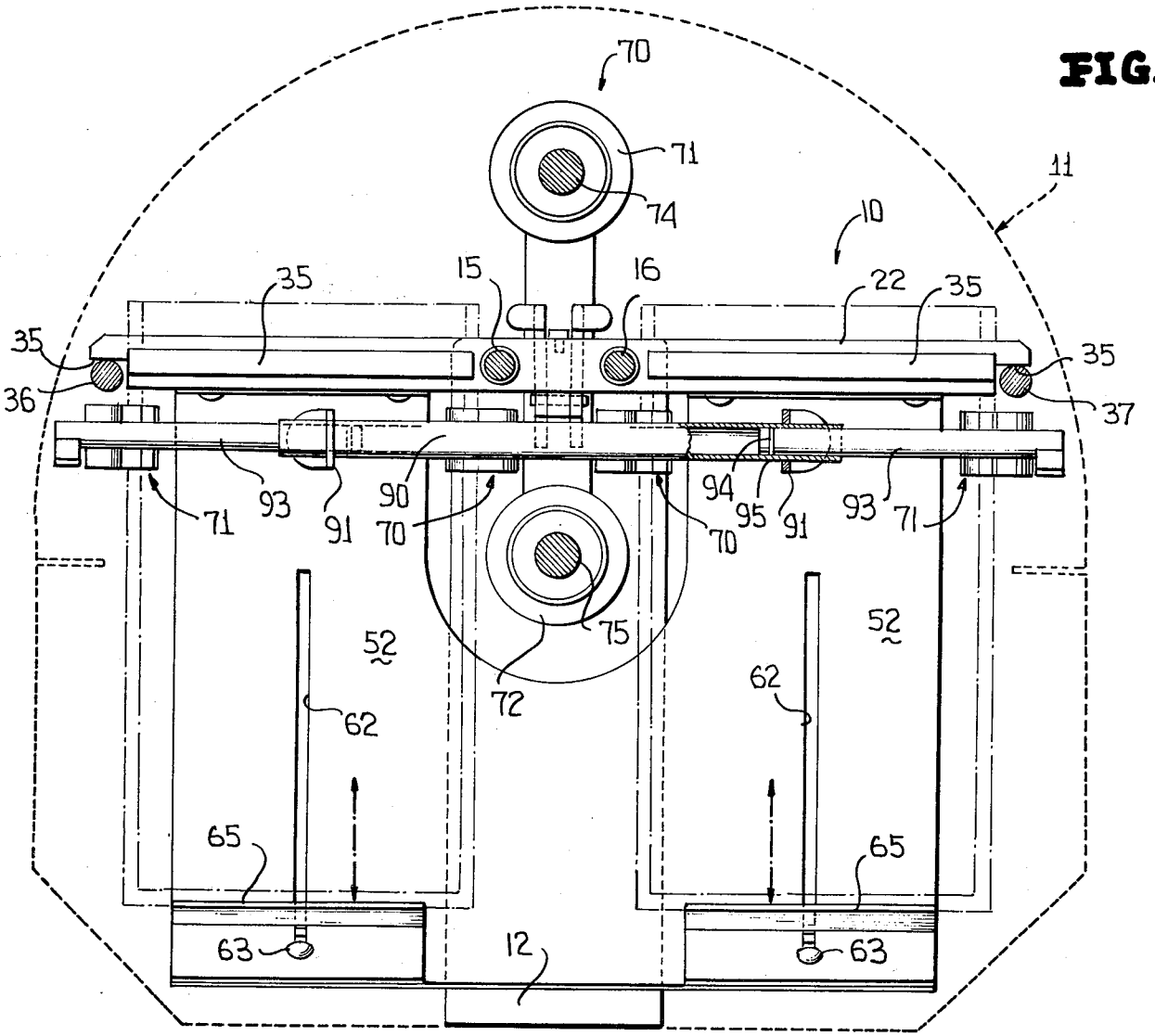
FIG. 2 is a sectional view taken generally along line 2—2 of FIG. 1, and illustrates the manner in which a plurality of pressure bars are mounted for horizontal sliding movement along horizontally disposed parallel rods.

A novel sealing unit constructed in accordance with this invention for sealing the open mouths of containers, particularly flexible packages or pouches, is generally designated by the reference numeral 10 and is illustrated in FIGS. 1 and 2 housed within a chamber (unnumbered) of a conventional autoclave 11.

The sealing unit 10 includes a base plate 12 (FIG. 1) and two upstanding legs 13, 14 spanned by a pair of cylindrical rods 15, 16 which are disposed generally horizontally and in parallel relationship to each other. The rods 15, 16 are secured by conventional nuts 17 (FIG. 1) to the legs 13, 14. A plurality of pressure bars 21 through 30 (FIG. 1) are provided with cylindrical bores (unnumbered) through which pass the rods 15, 16. The pressure bar 30 is preferably held stationary against the leg 14 in any conventional manner, as by bolts or the like, while the remaining pressure rods or arms 21 through 29 are capable of moving in generally a horizontal plane between open and closed positions which are respectively illustrated at the upper and lower portions of FIG. 3 of the drawings. The pressure bars 22 through 29 are virtually identical and, as is best illustrated in FIG. 4 relative to the pressure bars 24 and 23, each includes a pressure surface 33 of one of the bars 22 which opposes a pressure surface 34 of a metallic insert 35 of another of the bars 23. Thus the surfaces 33, 34 are in opposing relationship to each other and, as will be described more fully hereinafter, are moved relative to each other between a fully opened position (FIGS. 7 and 8) and a closed position (FIG. 4 and a portion of FIG. 9). The terminal ends (unnumbered) of the pressure bars 22 through 30 are undercut to provide ledges 35 (FIG. 2) which ride upon upper surfaces (unnumbered) of cylindrical rods 36, 37 whose right hand ends, as viewed in FIG. 1, are joined by respective bolts 38 to a flange (unnumbered) of the leg 14. The rods 36, 37 can therefore be pivoted about a vertical axis, as defined by the bolts 38, as indicated by the unnumbered headed arrows associated therewith in FIG. 3. The ends of the rods 36, 37 remote from the bolts 38 are received in outwardly opening slots 40 of the arm 21 and are retained therein by a ball detent 41 (FIG. 1) which is spring biased upwardly, as viewed in FIG. 1, by a spring 42. Thus, as viewed in FIG. 3 the leftmost ends of the rods 36, 37 can be pivoted clockwise and counter-clockwise respectively to overcome the spring bias of the associated springs 42 to pass outwardly beyond the ball detents 41 to swing the rods 36, 37 to an out of the way position for loading and unloading purposes. In this manner the rods 15, 16, 36 and 37 provide means for mounting the various pressure bars 21 through 29 for sliding movement in generally a horizontal plane between the closed and opened positions illustrated respectively at the bottom and top of FIG. 3.

Figure 3:
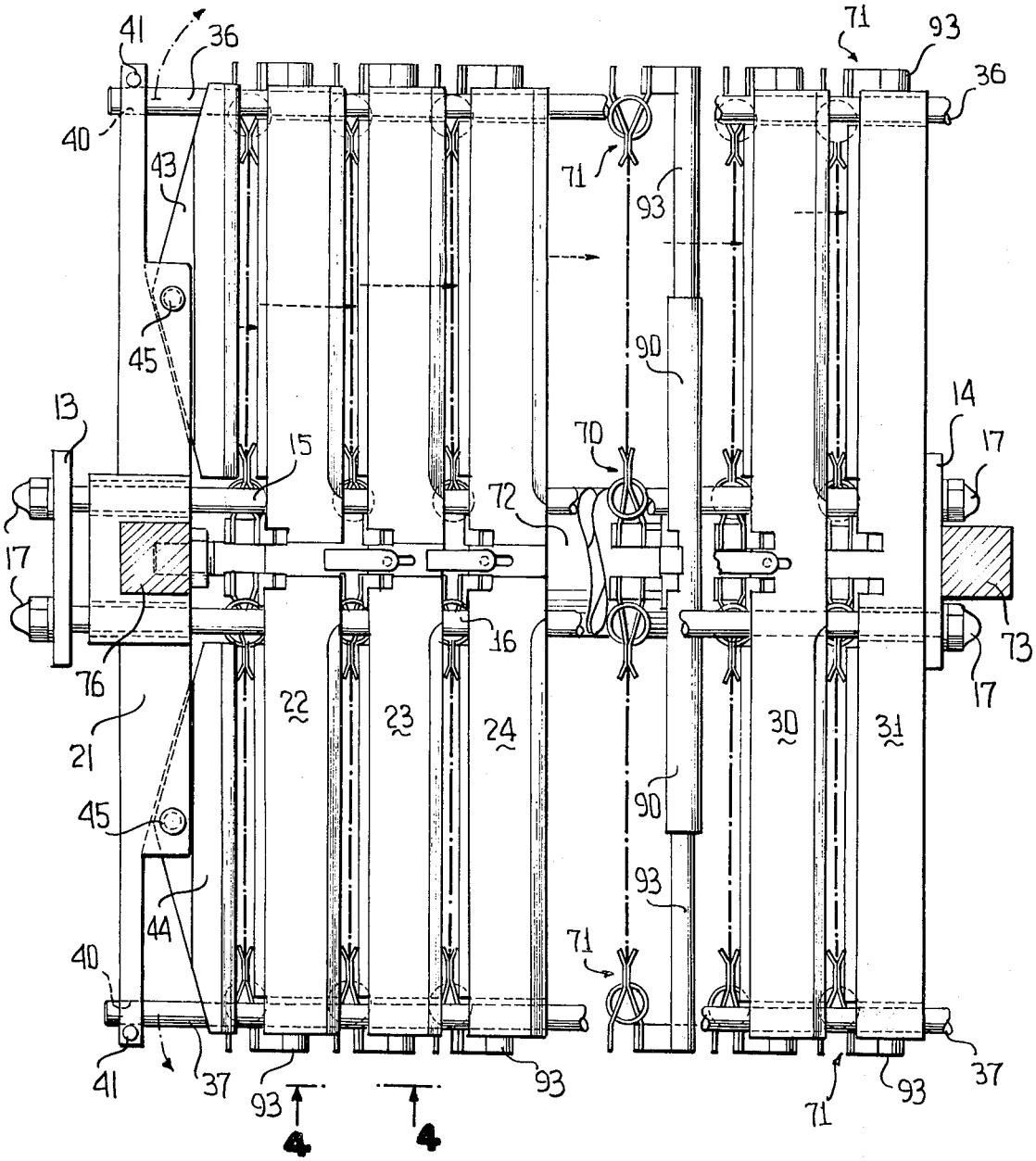
FIG. 3 is a top plan view of the sterilizing unit of FIGS. 1 and 2, and in the bottom portion thereof illustrates the pressure bars in their closed position and in the top view in their open position.

The pressure bars 22 through 30 are of a one-piece construction, whereas the pressure bar 21, though of a one-piece construction carries a pair of pressure bars 43, 44 mounted thereupon for pivotal movement about a vertical axis by bolts 45 (FIG. 3). The pivotally mounted pressure bars 43, 44 have pressure surfaces (unnumbered) corresponding to the surfaces 33 of the pressure bars 22 through 29 and these surfaces are in opposed relationship to the surfaces 34 of the insert 35 carried by the pressure bar 22. Thus, between all of the pressure bars 22 through 30 and the pressure bars 43, 44 opposing the pressure bar 22 there are opposing pressure surfaces 33, 34 for gripping therebetween and applying pressure to the opened mouths M (FIG. 4) of containers, such as pouches P constructed of flexible material.

Though not illustrated, the right-hand ends of the rods 36, 37, as viewed in FIG. 3, are suitably fixedly secured to the upper end (unnumbered) of the leg 14 or suitable extensions thereof. Thus, though rods 15, 16, the base 12, and the legs 13, 14 form a relatively rigid frame for the overall sealing unit 10 whereas the rods 36, 37 may be pivoted about their respective bolts 38 in the manner heretofore described.

Each pouch P is supported by the sealing unit 10 within the autoclave 11 by various supporting means, including a plurality of inclined plates 52 through 61 carried by the respective pressure bars 22 through 31. Each of the plates or supports 52 through 61 is inclined and are arranged in pairs at opposite side of a longitudinal center line taken through the sealing unit 11, as is best indicated by the plates 52, 52 of FIG. 2. Each of the plates 52 through 61 has a vertical slot 62 which receives therethrough a bolt 63 carrying a wing nut 64. The bolt 63 passes through an opening formed in a leg (unnumbered) of a supporting platform or ledge 65 of each of the plates 52 through 61. By loosening the wing nut 64 the plate 65 can be adjusted upwardly or downwardly within the slot 62, as is indicated by the unnumbered headed arrows associated therewith, and upon tightening the wing nut 64 the vertical disposition of the platform 65 can be regulated to thereby accommodate pouches of different heights or vertical lengths, as is most apparent in FIG. 1 relative to the pouch P being illustrated with its bottom T supported upon the associated plate 65 as well as upon the inclined plate 53.

Each of the pouches P has front and back walls (unnumbered) sealed along the edges to form opposite lateral edges L which are gripped or clamped by pairs of clip means in the form of a pair of clips 70, 71 associated with each of the pressure bars 22 through 31 at opposite sides of a longitudinal center line through the sealing unit 10. All of the clips 70, which might be termed the innermost clips since they are disposed innermost relative to the sealing unit 10 and the autoclave unit 11 are identical, as are the outermost clips 71.

The pressure bars or arms 21 through 30 are moved relative to each other and relative to the pressure arms or bar 31 by a mechanism generally designated by the reference numeral 70 (FIGS. 1 and 2) which includes a pair of fluid cylinders 71, 72 secured by a generally U-shaped bracket 73 to the leg 14 of the sealing unit 10. Piston rods 74, 75 carrying pistons (not shown) within the respective cylinders 71, 72 are coupled to a plate 76 which is in turn fastened to the arm 21. Fluid conduits (not shown) from a suitable source of pressurized fluid (also not shown) are connected to the rod and head end of the cylinders 71, 72 to selectively reciprocate the rods 74, 75, as indicated by the unnumbered headed arrows associated therewith (FIG. 1). A plurality of identical plates 77, (FIG. 8) are welded or otherwise secured at one end thereof to each of the pressure bars 21 through 30, and each carries a vertically depending detent 78, (FIG. 8) which is received in a longitudinal upwardly opening slot 80 of an associated one of the pressure arms 22 through 30. For example, as is best illustrated in FIGS. 7 through 9 the pressure bars 22 through 25 have welded thereto an end of each of the plates 77 with the detent of the plate 77 welded to the pressure bar 22 being received in the slot 80 of the pressure bar 23. Likewise, the detent of the plate 77 carried by the pressure bar 23 is received in the slot 80 of the pressure bar 24 while the detent carried by the plate 77 welded to the pressure bar 24 is carried in the slot 80 of the pressure bar 25. With the lost motion linkage system just described, and assuming that the pressure bars 21 through 31 are in the opened positions thereof (FIG. 3) fluid introduced into the cylinders 71, 72 such as to retract the piston rods 74, 75 thereinto will draw the plate 76 to the right, as viewed in FIG. 1, and this motion will in turn be imparted to the remaining pressure bars 22 through 30 from the pressure bars 43, 44 and the opened mouths (unnumbered) of the pouches P positioned between adjacent pairs of the pressure bars, in the manner to be described more fully hereinafter to move all of the pressure bars 21 through 30 to the right and clamp between the opposing sufaces 33, 34 the opened mouths M of the pouches P. Likewise, fluid introduced into the cylinders 71, 72 to urge the pistons 74, 75, respectively, to the left, as viewed in FIG. 1, will draw the plate 76 to the left as viewed in the same figure which in turn will cause the detents 78 to move along the slots 80 until they abut the left-hand most ends thereof, as viewed in FIGS. 8 through 9, whereupon the pressure bars will be progressively drawn to the left, as viewed in FIGS. 3, to open the gap between the opposing pressure surfaces 33, 34 to release the mouth M of the pouches P disposed therebetween. The same movement imparted to the pressure bars is, of course, imparted to the plates 52 through 61 carried thereby, and therefore the pressure bars 21 through 30 when moved to the right carry the plates 52 through 60 in the same direction and vice versa.

Reference is now made to FIGS. 3, 4 and 5 of the drawings which illustrates the manner in which the clips 70, 71 are supported by the plates 52 through 61 so that as the latter move in conjunction with the pressure bars 21 through 30 the mouths M of the pouches P clamp between the clips 70, 71 are likewise moved therewith. The clips 70 which are innermost or inboard relative to the longitudinal center line of the sealing unit 10 are spring clips having first and second clamping lips 85, 86 (FIG. 7) with a spring 87 normally urging the lips 85, 86 to the closed position (FIG. 7). The lip 85 of each of the clips 70 is rigidly secured to a generally L-shaped bracket 88 (FIG. 8) which is in turn secured to a tube 90 passed through apertures (unnumbered) of a pair of lugs 91 (struck from each of the plates 52 through 61). Each tube 90 is welded or otherwise secured to the lugs 91 so as to be immobile.

The lips 86 of each of the innermost clamps 70 are secured to an end (unnumbered) of a lever 91 (FIG. 8) which is journaled by a pivot pin 92 to each of the pressure bars 22 through 31 with an uppermost end (unnumbered) of each lever projecting above the pressure bars and the plates 77 associated therewith. The normal tension of each spring 87 maintains the lips 85, 86 of each innermost clip 70 in the closed position thereof (FIGS. 7 and 8). However, upon applying finger pressure to the upper ends of each of the levers 91 to move the same to the phantom to the solid outline position the lips 85, 86 are opened, a lateral edge L of a pouch P can be inserted therebetween, and upon the release of the associated lever 91 the spring 87 returns the same to the phantom outline position in FIG. 8 thereby clamping a lateral edge of each pouch between the lips 85, 86.

A rod 93 (FIGS. 2, 3, 5 and 8) is telescoped internally of each of the tubes 90, and each rod 93 includes a groove 94 (FIG. 2) receiving an O-ring 95 of resilient material which provides frictional purchase against the interior surface (unnumbered) of the tube 90. At an end of each rod 93 remote from the groove 94 and the O-ring 95 is fixed an associated one of the outermost clips 71 which, in the same manner as the clips 70, include a pair of clamping lips 96, 97 and a spring 98 (FIG. 5) which normally maintains the lips 96, 97 in the closed position thereof. However, upon squeezing the end of the clip remote from the lip 96 in the manner illustrated in phantom outline in FIG. 5 the lips 96, 97 are opened and a lateral edge L of one of the pouches P can be inserted therebetween, and upon the release of the latter-noted pressure the lips 96, 97 return to the solid outline position in FIG. 5 to clamp the lateral edge L of the pouch P therebetween.

It is to be particularly noted that each of the rods 93 cannot only be slid axially relative to their associated tubes 90 but can also be rotated from the normal operative clamped position of FIG. 4 to a position 90° removed therefrom, as shown in FIG. 6. The axial sliding motion of the rods 93 permits pouches P of different lateral dimensions to be inserted between pairs of the clips 70, 71, while the pivoting of the clips 71 to the position shown in FIG. 6 permits an operator to readily insert a pouch into the area between cooperative pressure bars to insert a lateral edge of the pouch between the lips 85, 86 of the innermost clips 70. In this fashion the sealing unit 10 can be readily loaded prior to and unloaded after a sterilization or autoclaving operation.

The autoclave 11 is of any conventional construction and includes appropriate means for sequentially evacuating the autoclave interior, conducting a sterilizing means thereinto, again evacuating the interior to withdraw the steam, through the apparatus of this invention heat sealing closed the pouches, and providing the usual collector for condensation.

After the pouches P have been loaded upon the sealing unit 10 in the manner heretofore described, the latter is inserted within the autoclave 11 and the same is closed. The autoclave interior is then first rapidly evacuated and is next filled with steam at approximately 250° F. After a predetermined dwell time or hole time, which will usually be in the range of 30 seconds to a few minutes, the autoclave interior is then again evacuated. At this point it is important to note that the normally opened mouths M of the pouches P are still opened and it is not until after the final evacuation following the sterilization that suitable pressurized fluid is introduced into the cylinders 71, 72 to subject the opened mouths M of the pouches P to pressure between the pressure surfaces 33, 34. Since the pouches are preferably constructed from material having heat sealing characteristics the heat of sterilization (250° F) is generally sufficient to achieve the hermetic seal across the mouths M. However, of extreme importance is the fact that the sealing step follows the final evacuation. If the sealing step preceded the final evacuation the heat seals just formed would still be relatively hot and thus weak, and when subjected to the final evacuation (with the sealing bars opened) the just formed heat seals would be strained to the point of failure. Thus, such failure is avoided by the pressure invention by delaying the final heat sealing until the steam has been evacuated.

Even if the just formed heat seals of the hermetically sealed packages could not be ruptured by exposure to the low pressure environment of the evacuation step immediately following sterilization, the time of exposure at 250° F to attain sterility of the product packaged in the pouches P, if it is a moisture free product, such as a surgical instrument, an artificial hip element, a bone screw, or similar device, is prohibitively long. However, since the contents of each pouch P are exposed to the sterilizing medium because the associated cooperative pairs of clips 70, 71 are moved toward each other after being clamped to the lateral edges L of the pouches P a sufficient distance lesser than the flattened lateral dimension of the pouches P, the mouths M are maintained in an opened position in the manner illustrated in phantom outline in FIG. 5. Thus, the dwell time is maintained at a minimum due to the direct introduction of the steam into the pouches P through the opened mouths thereof simply because of the known fact that microorganisms are killed rapidly by steam at 250° F while are likewise killed very slowly by dry air at 250° F. After this short dwell period followed by evacuation a positive seal of each mouth M can then be affected without in any way detracting from the integrity of the pouch and prior to the removal thereof from the sterile environment of the autoclave.

In essence the method practiced by the present invention is that of heat sealing the opened steam-sterilized pouches by pressure alone since immediately after the final evacuation of steam from the autoclave and before the return of the pouches therefrom to ambient temperature and pressure conditions externally of the autoclave the pouches including their internal sealing surfaces are still at approximately 250° F when subjected to the pressure of the pressure surfaces 33, 34 (at least 40 P.S.I.) and during a long dwell time (at least 5 seconds).

The following chart is exemplary of the sealing characteristics of a number of different candidate pouch constructions heat sealed at 250° F., a pressure of 45 P.S.I. and various dwell times:

| Pouch Structure | Dwell Time sec. | 10 sec. | 15 sec. | 20 sec. | 30 sec. |
|---|---|---|---|---|---|
| 1. .0005" polyester × HDPE | ←2600 grams/inch ± 200 g/inch → | | | | |
| 2. .0005" polyester × Blend* | 1400 | 4800 | 5000 | 5000 | 5100 |
| 3. .0005" polyester × PP copolymer | 2700 | 2800 | 2900 | 3000 | 2700 |
| 4. .0005" polyester × MDPE | 6000 | 6300 | 7000 | 7600 | 7000 |
| 5. .00075 nylon × MDPE | 4000 | 4100 | 4200 | 4400 | 4400 |

*HDPE and polyisobutylene blend
*Note: All tabulated values are grams/inch
HDPE = high density polyethylene
MDPE = medium density polyethylene
PP = polypropylene The seals of all of the pouch structures listed were found adequate to assure against accidental opening when the pouches or packages are removed from the autoclave and all are generally adequate for an indefinite, safe, sterile storage life at the location (hospital or the like) at which are sterilization is accomplished. However, if the pouches were to be shipped from the point of sterilization to a distant location weaker seals or unfused seals, illustrated by pouch structures 1 and 3 constructed from material of which the fusion point or sealing point is above 250° F might be suceptible to separation or opening and thus allowing the entrance of microorganisms. In such cases unfused or weakly fused final seals achieved in accordance with the present method may be subjected to a further heat sealing operation through the use of a simple hot bar sealer adjusted to a temperature in excess of 250° F — for example at 400° F, 40 P.S.I., ½ second dwell.

While preferred forms and arrangements of parts have been shown in illustrating the invention, it is to be clearly understood that various changes in detail and arrangement of parts may be made without departing from the spirit and scope of this disclosure.

I claim:

1. A sealing unit for an autoclave comprising means for supporting a plurality of open mouth containers in an upright condition, means for applying closing pressure to the open mouth of each container, said pressure applying means including a plurality of cooperative pairs of opposing pressure bars, means mounting said pressure bars for relative movement between a first position at which each cooperative pair of pressure bars are sufficiently spaced from each other to permit the open mouth of a container to be positioned therebetween and a second position at which each cooperative pair of pressure bars are closer to each other than at said first position whereby the open mouth of each container is closed by the pressure exerted thereon by the associated pair of pressure bars, means for relatively moving said pressure bars between the first and second positions thereof, and said mounting means mount said pairs of pressure bars for sliding movement relative to each other.

2. A sealing unit for an autoclave comprising means for supporting a plurality of open mouth containers in an upright condition, means for applying closing pressure to the open mouth of each container, said pressure applying means including a plurality of cooperative pairs of opposing pressure bars, means mounting said pressure bars for relative movement between a first position at which each cooperative pair of pressure bars are sufficiently spaced from each other to permit the open mouth of a container to be positioned therebetween and a second position at which each cooperative pair of pressure bars are closer to each other than at said first position whereby the open mouth of each container is closed by the pressure exerted thereon by the associated pair of pressure bars, means for relatively moving said pressure bars between the first and second positions thereof, each container includes opposite lateral edges, said container supporting means includes releasable clip means, said releasable clip means includes a pair of clips for clampingly engaging the lateral edges of an associated container adjacent the open mouth thereof, and means for pivoting an outermost one of each pair of clips about a generally horizontal axis to facilitate the introduction of an associated container into an innermost one of each pair of clips.

3. A sealing unit for an autoclave comprising means for supporting a plurality of open mouth containers in an upright condition, means for applying closing pressure to the open mouth of each container, said pressure applying means including a plurality of cooperative pairs of opposing pressure bars, means mounting said pressure bars for relative movement between a first position at which each cooperative pair of pressure bars are sufficiently spaced from each other to permit the open mouth of a container to be positioned therebetween and a second position at which each cooperative pair of pressure bars are closer to each other than at said first position whereby the open mouth of each container is closed by the pressure exerted thereon by the associated pair of pressure bars, means for relatively moving said pressure bars between the first and second positions thereof, and said means for relatively moving said pressure bars include a lost motion connection between adjacent pressure bars.

4. A sealing unit for an autoclave comprising means for supporting a plurality of open mouth containers in an upright condition, means for applying closing pressure to the open mouth of each container, said pressure applying means including a plurality of cooperative pairs of opposing pressure bars, means mounting said pressure bars for relative movement between a first position at which each cooperative pair of pressure bars are sufficiently spaced from each other to permit the open mouth of a container to be positioned therebetween and a second position at which each cooperative pair of pressure bars are closer to each other than at said first position whereby the open mouth of each container is closed by the pressure exerted thereon by the associated pair of pressure bars, means for relatively moving said pressure bars between the first and second positions thereof, said mounting means mount said pairs of pressure bars for sliding movement relative to each other along a generally horizontal path of travel, said mounting means include a pair of generally horizontally disposed parallel rods along which said pressure bars slide, and means mounting one of said rods at an end thereof for pivotal movement about a generally vertical axis.

5. A sealing unit for an autoclave comprising means for supporting a plurality of open mouth containers in an upright condition, means for applying closing pressure to the open mouth of each container, said pressure applying means including a plurality of cooperative pairs of opposing pressure bars, means mounting said pressure bars for relative movement between a first position at which each cooperative pair of pressure bars are sufficiently spaced from each other to permit the open mouth of a container to be positioned therebetween and a second position at which each cooperative pair of pressure bars are closer to each other than at said first position whereby the open mouth of each container is closed by the pressure exerted thereon by the associated pair of pressure bars, means for relatively moving said pressure bars between the first and second positions thereof, each container is a flexible pouch additionally defined by a bottom, front and back wall, and opposite lateral edges, said mounting means mount said pairs of pressure bars for sliding movement relative to each other, said container supporting means includes releasable clip means, said releasable clip means includes a pair of clips for clampingly engaging the lateral edges of an associated pouch adjacent the open mouth thereof, means mounting each pair of clips for relative movement toward and away from each other to accommodate pouches of different lateral dimensions, and said means for relatively moving said pressure bars include a lost motion connection between adjacent pressure bars.

6. The sealing unit as defined in claim 5 including means for pivoting an outermost one of each pair of clips about a generally horizontal axis to facilitate the introduction of an associated container into an innermost one of each pair of clips.

7. The sealing unit as defined in claim 6 wherein said mounting means include a pair of generally horizontally disposed parallel rods along which said pressure bars slide.

8. The sealing unit as defined in claim 7 including means mounting one of said rods at an end thereof for pivotal movement about a generally vertical axis.

9. The sealing unit as defined in claim 1, wherein each container includes opposite lateral edges, said container supporting means includes releasable clip means, said releasable clip means includes a pair of clips for clampingly engaging the lateral edges of an associated container adjacent the open mouth thereof, and means mounting each pair of clips for relative sliding movement forward and away from each other to accommodate containers of different lateral dimensions.

10. The sealing unit as defined in claim 2 including means mounting each pair of clips for relative sliding movement toward and away from each other to accommodate containers of different lateral dimensions.

11. The sealing unit as defined in claim 3 wherein each container includes opposite lateral edges, said container supporting means includes releasable clip means, said releasable clip means including a pair of clips for clampingly engaging the lateral edges of an associated container adjacent the open mouth thereof, and means mounting each pair of clips for relative sliding movement toward and away from each other to accommodate containers of different lateral dimensions.

12. The sealing unit as defined in claim 4 wherein each container includes opposite lateral edges, said container supporting means includes releasable clip means, said releasable clip means including a pair of clips for clampingly engaging the lateral edges of an associated container adjacent the open mouth thereof, and means mounting each pair of clips for relative sliding movement toward and away from each other to accommodate containers of different lateral dimensions.

* * * * *